US011464336B2

(12) United States Patent
Jeong et al.

(10) Patent No.: US 11,464,336 B2
(45) Date of Patent: Oct. 11, 2022

(54) PANEL ASSEMBLY AND HOME APPLIANCE HAVING THE SAME

(71) Applicant: Samsung Electronics Co., Ltd., Suwon-si (KR)

(72) Inventors: Heesoo Jeong, Suwon-si (KR); Hyeongjin Jang, Suwon-si (KR); Sihwan Kim, Suwon-si (KR); Hongman Chang, Suwon-si (KR); Cheoleun Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 123 days.

(21) Appl. No.: 16/595,835

(22) Filed: Oct. 8, 2019

(65) Prior Publication Data

US 2020/0113332 A1 Apr. 16, 2020

(30) Foreign Application Priority Data

Oct. 12, 2018 (KR) ..... 10-2018-0122090

(51) Int. Cl.
*A47B 96/20* (2006.01)
*E06B 3/72* (2006.01)
(Continued)

(52) U.S. Cl.
CPC ..... *A47B 96/20* (2013.01); *A47L 15/4265* (2013.01); *E06B 3/72* (2013.01);
(Continued)

(58) Field of Classification Search
CPC ..... A47B 96/20; A47L 15/4265; F24C 15/02; F24C 15/06; F24C 15/08; F25D 23/02; F25D 23/063; E06B 3/72; E06B 5/006
(Continued)

(56) References Cited

U.S. PATENT DOCUMENTS 4,320,614 A 3/1982 Brezosky
4,966,424 A * 10/1990 Schneider ..... F16B 12/38 312/265.6

(Continued)

FOREIGN PATENT DOCUMENTS

DE 29 42 974 A1 5/1981
EP 0 081 249 A1 6/1983

(Continued)

OTHER PUBLICATIONS

International Search Report and Written Opinion of the International Searching Authority dated Dec. 20, 2019 in International Patent Application No. PCT/KR2019/011625.

(Continued)

*Primary Examiner* — James O Hansen
(74) *Attorney, Agent, or Firm* — Staas & Halsey LLP

(57) ABSTRACT

A panel assembly includes a frame panel including a front surface, an upper surface, a side surface, and a rear surface and is formed as a single sheet of a metal plate, and a corner member disposed in a gap formed between the upper surface of the frame panel and the side surface of the frame panel, wherein the corner member includes: an insertion member inserted into the gap to fill the gap, and a fixing member integrally formed with the insertion member and coupled to the rear surface of the frame panel to fix the corner member to the frame panel.

13 Claims, 13 Drawing Sheets

(51) Int. Cl.

| | |
|---|---|
| ***E06B 5/00*** | (2006.01) |
| ***A47L 15/42*** | (2006.01) |
| ***F24C 15/02*** | (2006.01) |
| ***F24C 15/08*** | (2006.01) |
| ***F25D 23/02*** | (2006.01) |
| ***F25D 23/06*** | (2006.01) |
| ***F24C 15/06*** | (2006.01) |
| *E06B 3/70* | (2006.01) |

(52) U.S. Cl.
CPC ..... *E06B 5/006* (2013.01); *F24C 15/02* (2013.01); *F24C 15/06* (2013.01); *F24C 15/08* (2013.01); *F25D 23/02* (2013.01); *F25D 23/063* (2013.01); *A47B 2230/01* (2013.01); *E06B 2003/7059* (2013.01)

(58) Field of Classification Search
USPC ..... 312/111, 140; 126/190
See application file for complete search history.

(56) References Cited

U.S. PATENT DOCUMENTS

| | | | | |
|---|---|---|---|---|
| 5,806,946 | A * | 9/1998 | Benner | H05K 7/183 312/265.3 |
| 7,322,770 | B2 | 1/2008 | Frank | |
| 7,494,198 | B2 | 2/2009 | Wing | |
| 9,151,505 | B2 | 10/2015 | Kim et al. | |
| 10,129,995 | B2 | 11/2018 | Kwon | |
| 2013/0273303 | A1 | 10/2013 | Carr et al. | |
| 2017/0159351 | A1 | 6/2017 | Kim et al. | |
| 2018/0035560 | A1 | 2/2018 | Kwon | |

FOREIGN PATENT DOCUMENTS

| | | |
|---|---|---|
| EP | 3 345 527 A1 | 7/2018 |
| KR | 20-0419197 | 6/2006 |
| KR | 10-1447691 | 10/2014 |
| KR | 10-2017-0065202 | 6/2017 |
| KR | 10-2018-0014392 | 2/2018 |

OTHER PUBLICATIONS

Extended European Search Report (dated Aug. 2, 2021) issued by the European Patent Office for European Patent Application No. 19871535.1.

Korean Office Action dated Aug. 16, 2022 for Korean Patent Application No. 10-2018-0122090.

* cited by examiner

PANEL ASSEMBLY AND HOME APPLIANCE HAVING THE SAME

CROSS-REFERENCE TO RELATED APPLICATIONS

This application is based on and claims priority under 35 U.S.C. 119 to Korean Patent Application No. 10-2018-0122090, filed on Oct. 12, 2018, in the Korean Intellectual Property Office, the disclosures of which is herein incorporated by reference in its entirety

BACKGROUND

1. Field

Apparatuses and methods consistent with the disclosure relate to a panel assembly having improved aesthetic impression and simplifying a manufacturing process and a home appliance including the same.

2. Description of the Related Art

Design, as well as functions, is important for a variety of home appliances. Therefore, various designs for enhancing the aesthetic impression of appearances of home appliances have been developed and applied.

In recent years, metal panels have been used in consideration of consumer's preference for color and texture and durability of home appliances. Generally, a frame panel having an appearance is manufactured by bending a sheet such as a metal plate, which is a raw material, to form a rough three-dimensional structure and subsequently joining junctions of respective surfaces formed due to curvature of the metal plate by welding or the like.

In such a frame panel, a sharp corner may be formed at a contact point where three or more different surfaces meet and a surface of the joints is roughly deformed during a welding process, thus degrading aesthetic impression of home appliances or users may bump into the corner and be hurt.

SUMMARY

Embodiments of the disclosure overcome the above disadvantages and other disadvantages not described above. Also, the disclosure is not required to overcome the disadvantages described above, and an embodiment of the disclosure may not overcome any of the problems described above.

The disclosure provides a panel assembly having improved aesthetic impression and simplifying a manufacturing process and a home appliance including the same.

According to an embodiment of the disclosure, a panel assembly includes: a frame panel including a front surface, an upper surface, a side surface, and a rear surface and formed as a single sheet of a metal plate; and a corner member disposed in a gap formed between the upper surface of the frame panel and the side surface of the frame panel, wherein the corner member includes: an insertion member inserted into the gap to fill the gap; and a fixing member integrally formed with the insertion member and coupled to the rear surface of the frame panel to fix the corner member to the frame panel.

The upper surface and the side surface may each be bent from edges of the front surface, and the rear surface may be bent from the upper surface and the side surface to face the front surface.

The insertion member may include a contact protrusion in contact with at least one of the upper surface of the frame panel and the side surface of the frame panel.

The contact protrusion may be formed in a longitudinal direction of the insertion member.

One surface of the fixing member may include a first coupling protrusion inserted into a first coupling opening formed on the rear surface of the frame panel.

One surface of the fixing member may include a third coupling opening formed at a position facing the second coupling opening formed on at least one of the upper surface of the frame panel and the side surface of the frame panel An outer surface of the insertion member may be formed to extend from the upper surface of the frame panel to the side surface of the frame panel without a step.

The outer surface of the insertion member may be formed to have a predetermined curvature between the upper surface of the frame panel and the side surface of the frame panel.

A radius of the curvature may be 2 mm or less.

The corner member may be formed of a synthetic resin material.

The side surface may include left and right sides of the frame panel.

The frame member may include a lower surface bent from the edge of the front surface, and the corner member may include an additional insertion member disposed in an additional gap formed between the side surface of the frame panel and the lower surface of the frame panel and filling the additional gap and a connecting member connecting the insertion member and the additional insertion member.

The insertion member, the additional insertion member, and the connecting member may be integrally formed.

The panel assembly may further include: a support member in contact with the front surface and the side surface and having a slide coupling portion to which the corner member is coupled.

The corner member may include a slide slot portion slidably coupled to the slide coupling portion.

One end of the side surface of the frame panel may have an extending portion extending along one end of the side surface to fix the support member.

The panel assembly may further include: an additional fixing member coupled to a rear of the corner member and the frame panel to fix the corner member.

According to another embodiment of the disclosure, a home appliance includes: a main body including an accommodation space; a door opening and closing the accommodation space; a frame panel forming at least a part of a front surface of the door; and a corner member disposed in a gap formed between an upper surface of the frame panel and a side surface of the frame panel, wherein the corner member includes: an insertion member inserted into the gap to fill the gap; and a fixing member formed integrally with the insertion member and coupled with the rear surface of the frame panel to fix the corner member to the frame panel.

The home appliance may further include: a control panel disposed on the front surface of the frame panel and; and a display provided on the control panel.

The frame panel may be formed of a metal material, and the corner member may be formed of a synthetic resin material.

Additional and/or other aspects and advantages of the disclosure will be set forth in part in the description which follows and, in part, will be obvious from the description, or may be learned by practice of the disclosure.

BRIEF DESCRIPTION OF THE DRAWINGS

The above and/or other aspects of the disclosure will be more apparent by describing certain embodiments of the disclosure with reference to the accompanying drawings, in which.

DETAILED DESCRIPTION

In order to fully understand the structure and effect of the disclosure, preferred embodiments of the disclosure will be described with reference to the accompanying drawings. However, the disclosure is not limited to the embodiments described below, but may be implemented in various forms and various modifications may be made. It should be understood, however, that the description of the embodiments is provided to enable the disclosure to be complete, and to fully convey the scope of the disclosure to those skilled in the art to which the disclosure pertains. In the accompanying drawings, the elements are enlarged in size for convenience of explanation, and the proportions of the elements may be exaggerated or reduced.

When an element is described as being "on" or "abut on" another element, the element may be directly in contact with or coupled to another element, or there may be another element in between. On the other hand, when it is described that an element is "directly on" or "directly adjacent" to another element, it may be understood that there is no other element in between. Other expressions that describe the relationship between components, for example, "between" and "directly between" may also be construed similarly.

Terms, "first", "second", and the like, may be used to describe various elements, but the elements are not limited to the terms. The terms are used only to distinguish one element from another element. For example, a first element may be designated by a second element without departing from the scope of the disclosure. Similarly, a second element may also be designated by a first element.

In the description, the singular forms "a", "an" and "the" are intended to include the plural forms as well, unless the context clearly indicates otherwise. It will be understood that the terms "comprising", "including", "having" and variants thereof specify the presence of stated features, numbers, steps, operations, elements, components, and/or groups thereof, but do not preclude the presence or addition of one or more other features, numbers, steps, operations, elements, components, and/or groups thereof.

Unless defined otherwise, terms used herein have the same meaning as commonly understood by one of ordinary skill in the art to which this disclosure belongs.

Figure 1:
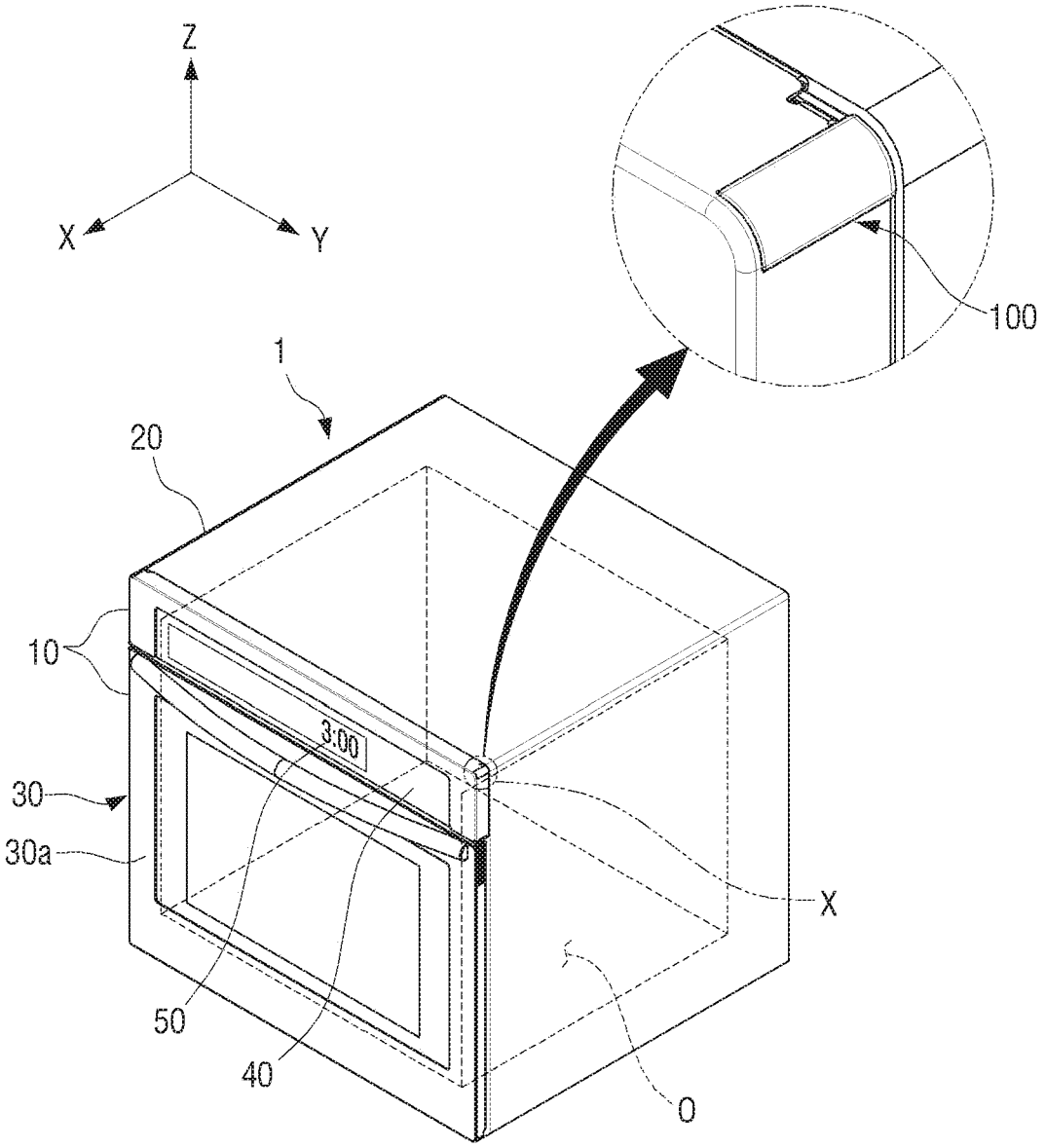
FIG. 1 is an enlarged perspective view of a home appliance and a region X according to an embodiment of the disclosure.
Figure 2:
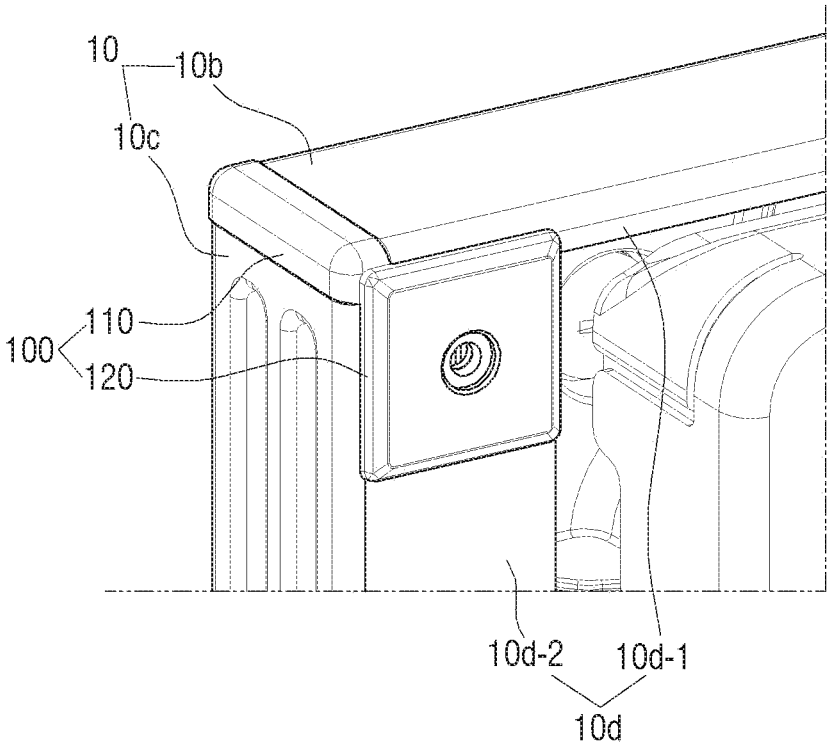
FIG. 2 is a rear assembled perspective view of a region X of FIG. 1, showing a frame panel and a corner member.

FIG. 1 is an enlarged perspective view of a home appliance 1 and a region X according to an embodiment of the disclosure, and FIG. 2 is a rear assembled perspective view of the region X of FIG. 1, showing a frame panel 10 and a corner member 100.

The home appliance 1, an electric appliance used at homes and may do various household chores. The home appliance 1 may be one of a washing machine, a dryer, a clothes treating device, a refrigerator, a vacuum cleaner, a microwave oven, an air-conditioner, an air purifier, a dehumidifier, and an oven.

In the following, as shown in FIG. 1, the home appliance 1 is mainly described as an oven but the home appliance 1 of the disclosure may be equally applied to various products as necessary.

The home appliance 1 may include a main body 20 having an accommodation space O therein, a door 30 for opening and closing the accommodation space O, and a panel assembly forming at least a portion of a front surface 30*a* of the door 30.

The panel assembly may include a frame panel 10 and a corner member 100 disposed at a gap S (See FIG. 3A) formed between an upper surface 10*b* of the frame panel 10 and a side surface 10*c* of the frame panel 10.

The main body 20 may form an appearance of the home appliance 1 and include the accommodation space O therein. Accordingly, the main body 20 may prevent foreign objects from entering the accommodation space O and protect various parts inside the home appliance 1 against the outside.

The accommodation space O may be used as a cooking chamber and have a box shape, and a front side thereof is opened to allow food to be drawn in or out.

The door 30 has a size corresponding to a shape of the front side of the accommodation space O to open and close the accommodation space O and is pivotally coupled to one side of the main body 20.

The frame panel 10 may form at least a portion of a front surface 30*a* of the door 30 or may be disposed adjacent to the front surface 30*a* of the door 30. In addition, if there are a plurality of frame panels 10, the plurality of frame panels 10 may be combined to form the entirety of the front surface 30*a* of the door 30.

In addition, the frame panel 10 may be an element of various components and panel assemblies configuring the home appliance 1.

The main body 20 and the door 30 may be formed of a metallic material or may also be formed of a synthetic resin material or other compositions. Thus, the frame panel 10 may also be formed of a metallic material or may be formed of a synthetic resin material and other compositions.

Hereinafter, for the purposes of description, it is assumed that the frame panel 10 is formed of a metallic material. In addition, the frame panel 10 may have a color inherent to a raw material and an outer surface thereof may be colored by separate coating. For example, the frame panel 10 may be formed of a metallic material such as aluminum, iron, or the like to have a color inherent to the metal and may be coated on the outer surface in a color such as white, black, or the like.

The frame panel 10 is formed of a single sheet of metal plate and includes a front surface 10*a*, an upper surface 10*b*, a side surface 10*c*, and a rear surface 10*d*. Here, the side surface 10*c* may include both a left side and a right side of the frame panel 10.

That is, the corner members 100 to be described later may be disposed on both sides of the frame panel 10 including the left and right sides thereof.

Specifically, the frame panel 10 may be formed by bending a single sheet of metal plate, and accordingly, the frame panel 10 may include the front surface 10*a* and an upper surface 10*b* and a side surface 10*c* bent from the edges of the front surface 10*a*.

A rear surface 10*d* may be bent from the upper surface 10*b* and the side surface 10*c* of the frame panel 10 and face the front surface 10*a* of the frame panel 10.

Figure 3A:
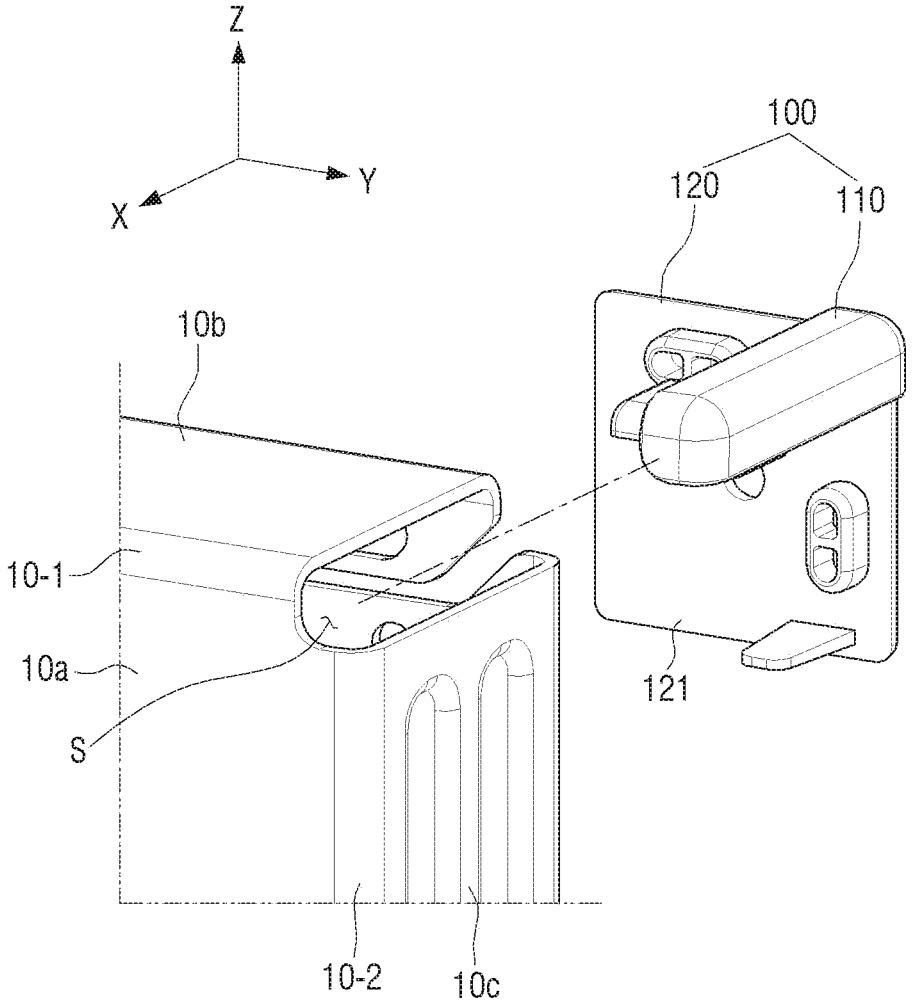
FIG. 3A is an exploded perspective view showing a frame panel and a corner member.

That is, as illustrated in FIG. 3A, an upper edge of the front surface 10*a* of the frame panel 10 may be bent to form the upper surface 10*b* of the frame panel 10 and a first bent portion 10-1 may be formed between the front surface 10*a* and the upper surface 10*b*. The first bent portion 10-1 may have a predetermined curvature.

Similarly, as illustrated in FIG. 3A, a right edge of the front surface 10*a* of the frame panel 10 may be bent to form a side surface 10*c* of the frame panel 10 and a second bent portion 10-2 may be formed between the front surface 10*a* and the side surface 10*c* of the frame panel 10.

Figure 3B:
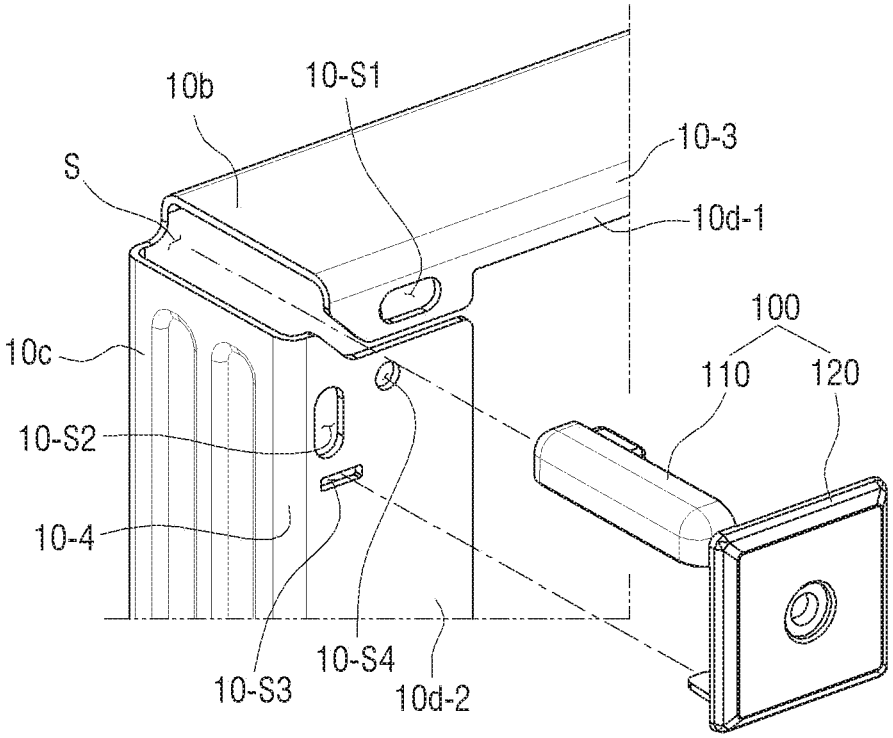
FIG. 3B is a rear exploded perspective view showing a frame panel and a corner member.

As illustrated in FIG. 3B, the rear surface 10*d* of the frame panel 10 may include a first rear surface 10*d*-1 bent from the edge of the upper surface 10*b* of the frame panel 10 and a second rear surface 10*d*-2 bent from the edge of the side surface 10*c* of the frame panel 10.

Because the rear edge of the upper surface 10*b* of the frame panel 10 is bent to form the first rear surface 10*d*-1 of the frame panel 10, a third bent portion 10-3 may be formed between the upper surface 10*b* and the first rear surface 10*d*-1 of the frame panel 10.

Similarly, because the rear edge of the side surface 10*c* of the frame panel 10 is bent to form the second rear surface 10*d*-2 of the frame panel 10, a fourth bent portion 10-4 may be formed between the side surface 10*c* and the second rear surface 10*d*-2 of the frame panel 10.

A control panel 40 receives an operation command regarding the home appliance 1 and may be disposed on the front surface of the frame panel 10. In addition, the control panel 40 may form a part of the front surface of the main body 20.

The control panel 40 may be an instrument panel including control meters which indicate operations of the home appliance 1 or which are collected at one place and easily managed to allow a user may control the operations of the home appliance 1.

The control panel 40 may be formed of a metallic material.

In addition, the control panel 40 may include a display 50 capable of displaying operational information of the home appliance 1.

Specifically, the display 50 may display specific characters, pictures, and the like capable of displaying the operational information of the home appliance 1, and the user of the home appliance 1 may clearly recognize an operational state of the home appliance 1 through visible information displayed on the display 50.

The corner member 100 may be disposed at a corner portion of the frame panel 10 and may be formed of a synthetic resin material. Thus, when the corner member 100 is formed of a synthetic resin material, the corner member 100 may be mass-produced, thus reducing a manufacturing cost.

The front surface 10*a*, the upper surface 10*b*, the side surface 10*c*, and the rear surface 10*d* of the frame panel 10 formed through a single sheet of a metal plate are not connected by welding and a gap S may be formed between the upper surface 110*b* and the side surface 110*c*.

Therefore, the corner portion of the frame panel 10 may include the empty gap S instead of a sharp tip, and the corner member 100 which may replace a corner of the frame panel 10 may be coupled to the gap S.

In addition, a color of the corner member 100 may be the same as that of the frame panel 10. Accordingly, the user may feel improved aesthetic feeling through the natural shape and color of the corner member 100 connected to the frame panel 10.

Hereinafter, a specific structure of the corner member 100 and a coupling structure of the frame panel 10 and the corner member 100 will be described in detail with reference to FIGS. 3A to 4.

Figure 4:
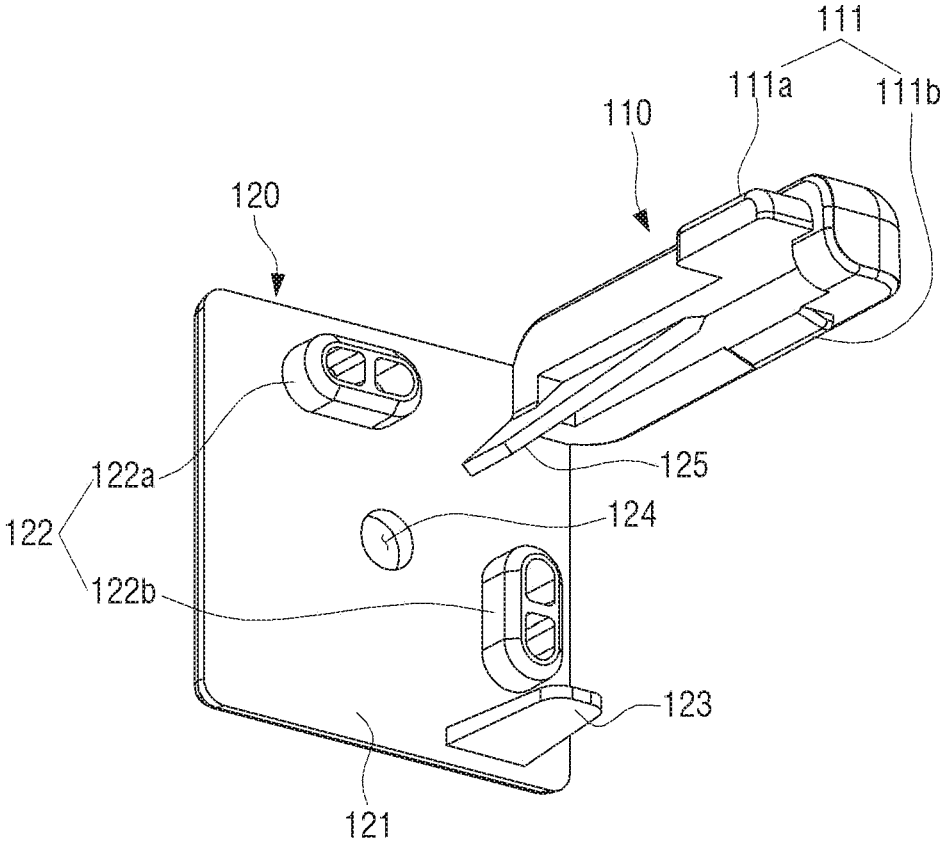
FIG. 4 is a perspective view showing a corner member.
Figure 5:
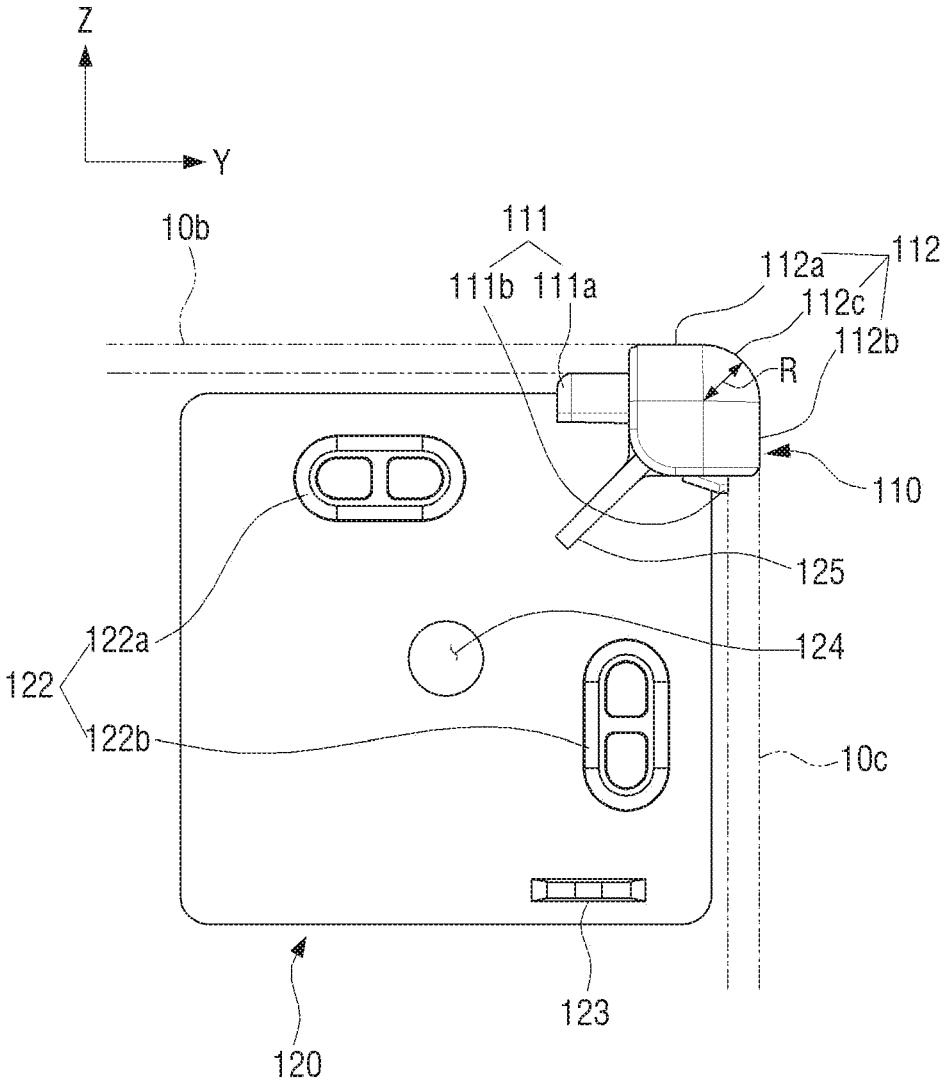
FIG. 5 is a front view showing a corner member.

FIG. 3A is an exploded perspective view showing the frame panel 10 and the corner member 100, FIG. 3B is a rear exploded perspective view showing the frame panel 10 and the corner member 100, FIG. 4 is a perspective view of the corner member 100, and FIG. 5 is a front view showing the corner member 100.

The corner member 100 may be disposed at the gap S formed between the upper surface 10*b* of the frame panel 10 and the side surface 10*c* of the frame panel 10.

Specifically, the corner member 100 may include an insertion member 110 inserted into the gap S to fill the gap S and a fixing member 120 integrally formed with the insertion member 110 and coupled to the rear surface 10*d* of the frame panel 10 to fix the corner member 100 to the frame panel 10.

The insertion member 110 is formed in a substantially columnar shape, inserted into the gap S, and exposed to the outside and includes an outer surface 112 extending from the upper surface 10*b* of the frame panel 10 to the side surface 10*c* of the frame panel 10 without a step.

Referring to FIG. 5, the outer surface 112 may include a first outer surface 112*a* in contact with the upper surface 10*b* of the frame panel 10, a second outer surface 112*b* in contact with the side surface 10*c* of the frame panel 10, and a third outer surface 112*c* disposed between the first outer surface 112*a* and the second outer surface 112*b* and having a predetermined curvature.

Specifically, the first outer surface 112*a* may be formed as a predetermined flat surface without a step with the upper surface 10*b* of the frame panel 10 and aligned with an extension line of the upper surface 10*b* of the frame panel 10.

The second outer surface 112*b* may be disposed to be substantially perpendicular to the first outer surface 112*a* and may be formed as a predetermined flat surface without a step with the side surface 10*c* of the frame panel 10.

Accordingly, the corner member 100 may be disposed in the frame panel 10 without a step, and the user may feel an improved aesthetic feeling for the smooth coupling structure of the frame panel 10 and the corner member 100.

The third outer surface 112*c* may be formed to have a predetermined curvature between the upper surface 10*b* of the frame panel 10 and the side surface 10*c* of the frame panel 10.

Also, a radius R of the curvature may be 2 mm or less. However, the radius of the curvature may vary, and here, if the radius R of the curvature is too small, the user may be hurt due to an angular portion such as a tip, and thus, the curvature R may have an appropriate radius R in consideration of the aesthetic feeling of the user.

Accordingly, the user may feel natural aesthetic feeling for the edge of the home appliance 1 through the bent outer surface 112 of the corner member 100, and a more smooth and smaller curvature than a structure implemented by welding each corner may be formed.

The insertion member 110 may include a contact protrusion 111 in contact with at least one of the upper surface 10*b* of the frame panel 10 and the side surface 10*c* of the frame panel 10.

Specifically, as illustrated in FIG. 4, the contact protrusion 111 has a first contact protrusion 111*a* in contact with the upper surface 10*b* of the frame panel 10 and a second contact protrusion 111*b* in contact with the side surface 10*c* of the frame panel 10.

The first contact protrusion 111*a* may interfere with the upper surface 10*b* of the frame panel to fix a position of the insertion member 110 and prevent the insertion member 110 from escaping upward from the upper surface 10*b* of the frame panel 10.

The second contact protrusion 111*b* may interfere with the side surface 10*c* of the frame panel to fix the position of the insertion member 110 and prevent the insertion member 110 from laterally escaping from the side surface of the frame panel 10*c* of the frame panel.

Therefore, the contact protrusion 111 may prevent the corner member 100 from escaping from the frame panel 10.

If the contact protrusion 111 has a columnar shape, the contact protrusion 111 may be formed in a longitudinal direction of the insertion member 110. Accordingly, the contact protrusion 111 may enlarge a contact area with the frame panel 10 and more stably fix the corner member 100 to the frame panel 10.

Only the corner member 100 disposed at the right upper end of the frame panel 10 has been mainly described, but the corner member 100 may be disposed at all corners of the frame panel 10 in the same manner.

For example, the corner member 100 may be applied to any structure formed as the frame panel 10 formed of a single sheet of metal plate is bent, and in case that the frame panel 10 forms a door 30 of the home appliance 1, the corner member 100 may also be disposed at the door 30.

The fixing member 120 may include a fixing surface 121 in contact with the rear surface 10*d* of the frame panel 10 and the fixing surface 121 as one surface of the fixing member 120 may include first coupling protrusions 121 inserted into first coupling openings 10-S1 and 10-S2 formed on the rear surface 10*d* of the frame panel 10.

The first coupling openings 10-S1 and 10-S2 may be provided in plurality, and the number and a shape of the first coupling openings 10-S1 and 10-S2 may be equal to or the same as the number and a shape of the first coupling protrusions 122 inserted into the first coupling openings 10-S1 and 10-S2.

The first coupling protrusion 122 may be provided in plurality. For example, when the first coupling protrusion 122 is formed as two pieces, the first coupling protrusions 122*a* and 122*b* may be disposed perpendicular to each other.

Accordingly, the plurality of first coupling protrusions 122*a* and 122*b* inserted into the first coupling openings 10-S1 and 10-S2, respectively, may be stably fixed not to be rotated in one direction.

In addition, the first coupling protrusion 122 may be formed integrally with the fixing member 120.

Further, if necessary, the fixing surface 121 of the fixing member 120 may include an additional coupling protrusion 123, which is coupled to an additional coupling opening 10-S3 formed on the rear surface 10*d* of the frame panel 10.

The additional coupling protrusion 123 may be forcibly engaged or snap-engaged into the additional coupling opening 10-S3 to stably fix the corner member 100 to the frame panel 10.

The fixing member 120 may include a third coupling opening 124 formed on one surface thereof and formed at a position facing a second coupling opening 10-S4 formed on at least one of the upper surface 10*b* of the frame panel 10 and the side surface 10*c* of the frame panel 10.

A diameter of the third coupling opening 124 may be smaller than or equal to a diameter of the second coupling opening 10-S4. This allows a binding member (not shown) to be maintained in contact with the fixing member 120 and the frame panel 10 through the third coupling opening 124 and the second coupling opening 10-S4.

For example, the binding member (not shown) may be a variety of binding components such as screws and rivets.

A reinforcing rib 125 is disposed between a side surface of the insertion member 110 and the fixing surface 121 of the fixing member 120 to increase coupling rigidity between the insertion member 110 disposed to be substantially perpendicular to the fixing member 120 and the fixing member 120.

Thus, even if the insertion member 110 is impacted in one direction, the insertion member 110 may be held at a predetermined position without being bent with respect to the fixing member 120.

As described above, the corner member 100 according to an embodiment of the disclosure is coupled to the gap S of the frame panel 10 to replace the shape of the corner of the frame panel 10 with various shapes, as well as a curved shape, without separate welding or grinding.

In addition, because the panel assembly is assembled by connecting the front surface 10*a*, the upper surface 10*b*, and the side surface 10*c* of the frame panel 10 through the insertion member 110 without a separate welding process, the entire manufacturing process of the home appliance 1 including the panel 10 may be simplified.

The frame panel 10 and the corner member 100 may be formed of different materials. The corner member 100 may be formed of a synthetic resin material and may be formed by injection molding.

Thus, the corner member 100 may be easily manufactured in various colors and shapes. Accordingly, even if the frame panel 10 is formed of a metallic material, the corner member 100 having a desired shape and color may be manufactured and coupled to the frame panel 10 without any additional welding or grinding process. Therefore, delamination of a coating of the frame panel 10 and deformation of the color may be prevented and the corner of the frame panel 10 may be easily replaced with a desired shape.

Hereinafter, a specific structure of a corner member 1100 according to another embodiment of the disclosure will be described with reference to FIGS. 6A to 7B.

Figure 6A:
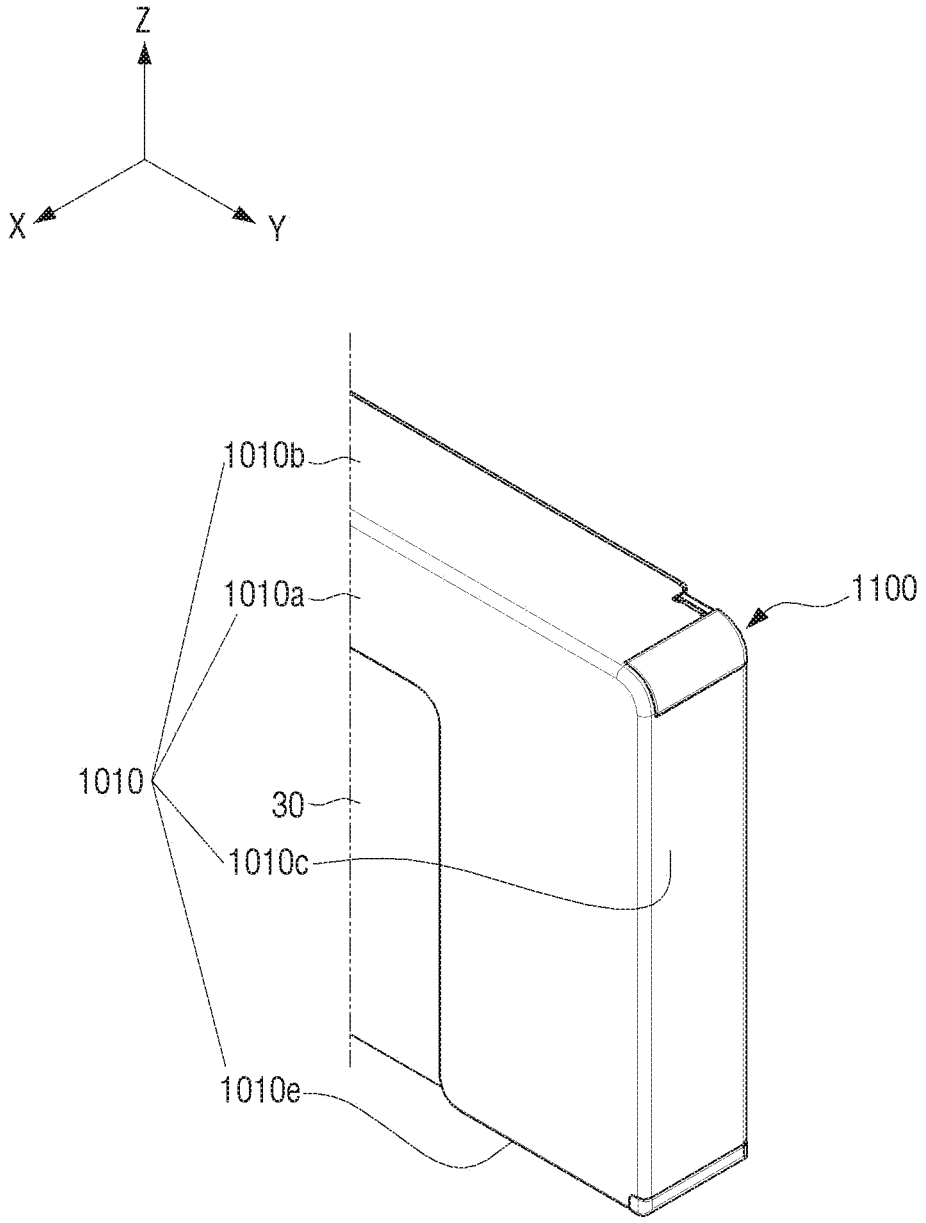
FIG. 6A is an assembled perspective view illustrating a corner member and a frame panel according to another embodiment of the disclosure.
Figure 6B:
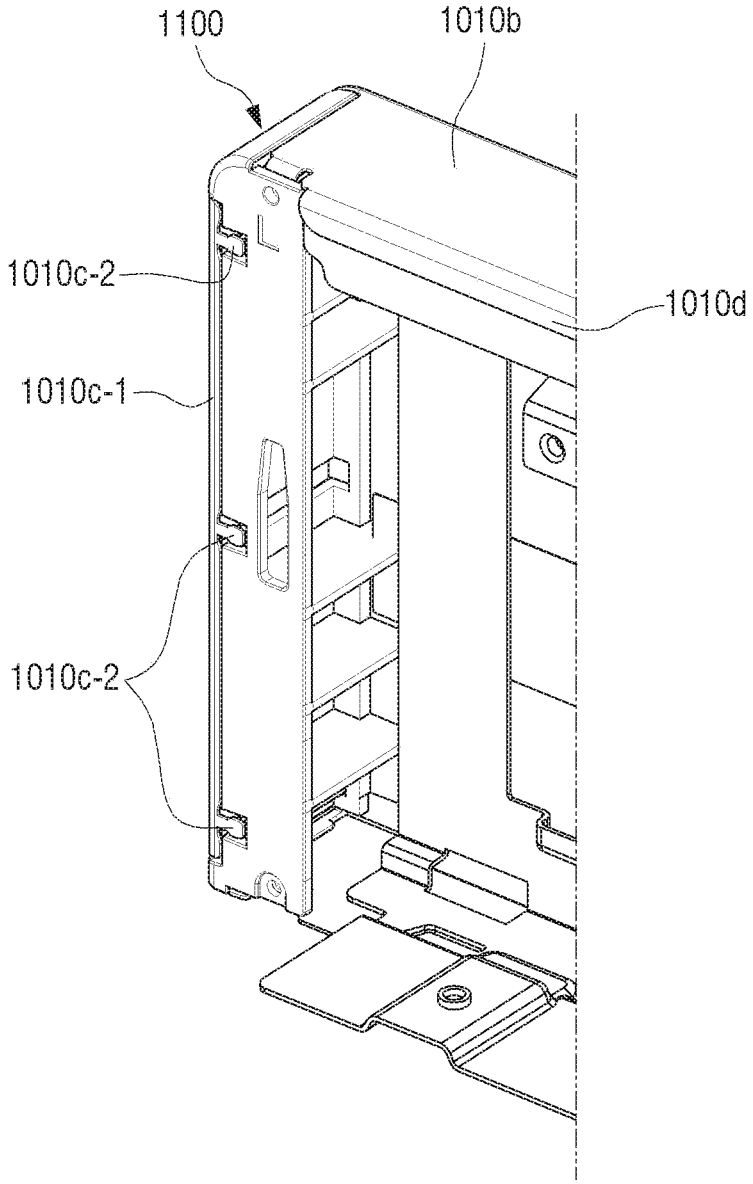
FIG. 6B is a rear assembled perspective view showing a corner member and a frame panel.

FIG. 6A is an assembled perspective view showing a corner member 1100 and a frame panel 1010 according to another embodiment of the disclosure, FIG. 6B is a rear assembled perspective view showing the corner member

Figure 7A:
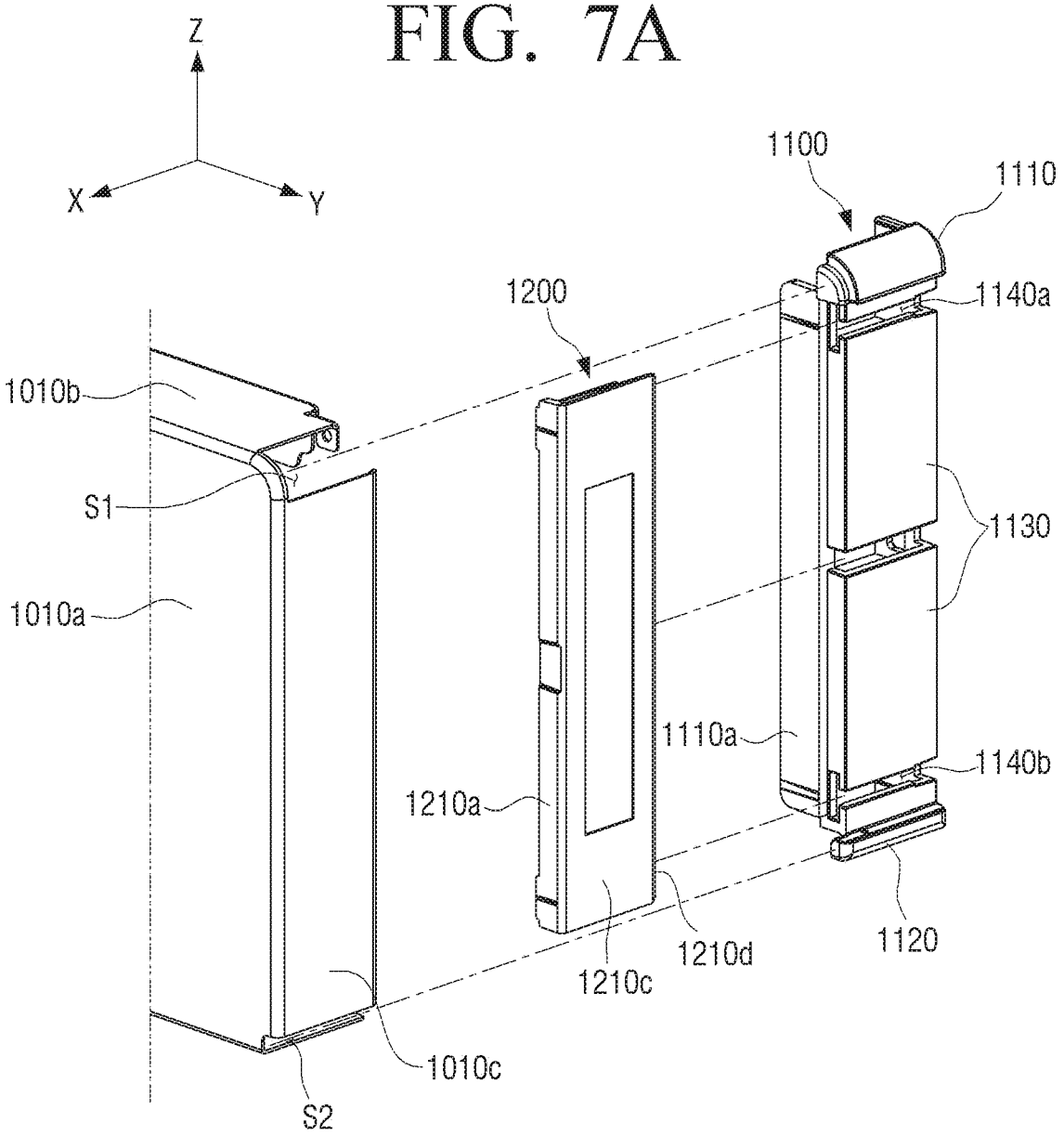
FIG. 7A is an exploded perspective view showing a frame panel, a support member, and a corner member.
Figure 7B:
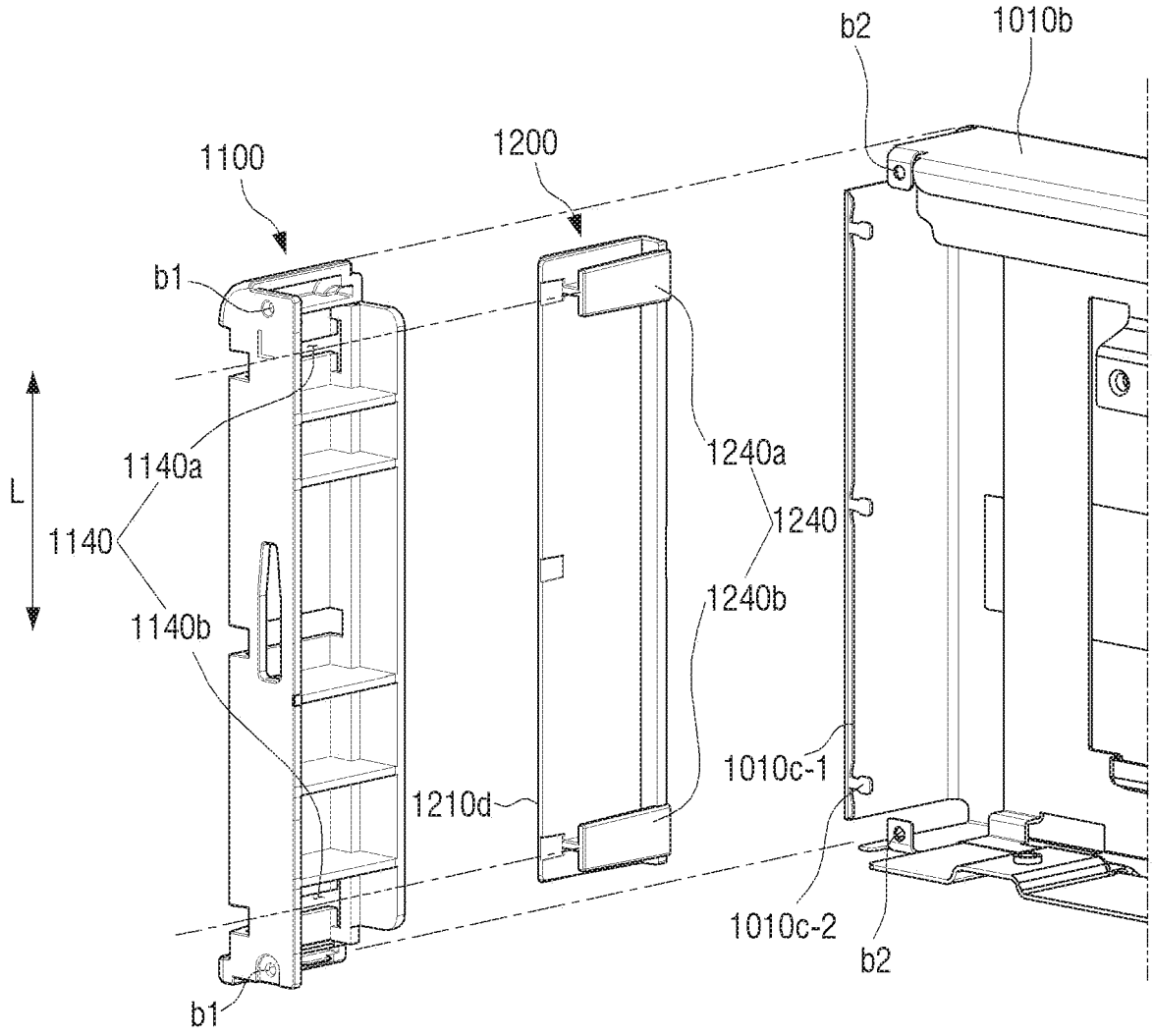
FIG. 7B is a rear exploded perspective view showing a frame panel, a support member, and a corner member.

1100 and the frame panel 1010, FIG. 7A is an exploded perspective view showing the frame panel 1010, a support member 1200, and the corner member 1100, and FIG. 7B is a rear exploded perspective view showing the frame panel 1010, the support member 1200, and the corner member 1100.

Here, the same reference numerals are used for the same components as those of the above-described configuration, and redundant descriptions will be omitted and only different components will be mainly described. For example, the control panel 40 is the same as the above-described component.

The frame panel 1010, which is different in reference numeral from the frame panel 10 described above, has the same configuration as the frame panel 10 described above and is different in that the frame panel 1010 further includes a lower surface 1010*e* to be described later.

The frame panel 1010 may include the lower surface 1010*e* bent from the edge of the front surface 1010*a* of the frame panel 1010. That is, the frame panel 1010 is formed as a single sheet of metal and edge regions of a front surface 1010*a* may be bent to form an upper surface 1010*b*, a side surface 1010*c*, and the lower surface 1010*e* of the frame panel 1010.

That is, the upper surface 1010*b* and the lower surface 1010*e* of the frame panel 1010 may be bent and disposed to face each other.

As illustrated in FIG. 7A, the frame panel 1010 may include the front surface 1010*a*, the upper surface 1010*b*, the side surface 1010*c*, and the lower surface 1010*e* formed through a single sheet of metal without being connected to each other by welding, and a first gap S1 may be formed between the upper surface 1010*b* and the side surface 1010*c*.

Similarly, a second gap S2 may be formed between the lower surface 1010*e* and the side surface 1010*c* of the frame panel 1010. A shape of the second gap S2 may be different from the first gap S1.

Here, the first gap S1 is the same as the gap S described above, and the second gap S2 may be referred to as an additional gap S2.

The first gap S1 and the second gap S2 may be formed at an upper right corner and a lower right corner of the frame panel 1010, respectively. Similarly, the first gap S1 and the second gap S2 may be formed at an upper left corner and a lower left corner of the frame panel 1010, respectively.

However, for the purposes of description, the first gap S1 and the second gap S2 formed at the upper right corner and the lower right corner of the frame panel 1010, respectively, will be mainly described.

The corner member 1100 may be simultaneously disposed in the first gap S1 and the second gap S2 to fill the first gap S1 and the second gap S2 simultaneously.

Specifically, the corner member 1100 may include a first insertion member 1110 inserted into the first gap S1 to fill the first gap S1, a second insertion member 1110 inserted into the second gap S2 to fill the second gap S2, and a connecting member 1130 connecting the first insertion member 1110 and the second insertion member 1120.

Here, the first insertion member 1110 may have the same shape as the insertion member 110 described above, and the second insertion member 1120 may be referred to as an additional insertion member 1120.

The shape of the first insertion member 1110 may be the same as the shape of the first gap S1 to fill the first gap S1 and the shape of the second insertion member 1120 may be the same as the shape of the second gap S2 to fill the second gap S2.

Accordingly, because the corner member 1100 fills the plurality of gaps S1 and S2 formed in the frame panel 1010 with one member, manufacturing cost of the home appliance 1 may be reduced and an improved aesthetic feeling may be provided to the user through a simple structure.

The first insertion member 1110, the second insertion member 1120, and the connecting member 1130 of the corner member 1100 may be integrally formed. Accordingly, it is not necessary to separately produce the respective members, thus reducing a production cost of the corner member 1100.

Further, because the first insertion member 1110, the second insertion member 1120, and the connecting member 1130 of the corner member 1100 are integrally formed with each other, a predetermined strength or higher, as compared with a structure formed by manufacturing and coupling separate members, may be maintained and the control panel 40 may be firmly supported.

In addition, the structure according to another embodiment of the disclosure may further include a support member 1200 which is in contact with the front surface 1010*a* and the side surface 1010*c* of the frame panel 1010 and has a slide coupling portion 1240 to which the corner member 1100 is coupled.

Specifically, the support member 1200 may be in contact with the front surface 1010*a* and the side surface 1010*c* of the frame panel 1010, supports the frame panel 1010, and is coupled with the corner member 1100 to fill the gaps S1 and S2 of the frame panel 1010.

For example, the support member 1200 may include a first support surface 1210*a* in contact with the front surface 1010*a* of the frame panel 1010 to support the front surface 1010*a* and a second support surface 1210*c* in contact with the side surface 1010*c* of the frame panel 1010 to support the side surface 1010*c*.

Accordingly, the support member 1200 may support the rear side of the frame panel 1010, thereby increasing rigidity of the structure of the frame panel 1010.

The support member 1200 may be in contact with the frame panel 1010 by an extending portion 1010*c*-1 of the frame panel 1010 and fixed.

Specifically, the extending portion 1010*c*-1 extends along one end of the side surface 1010*c* of the frame panel 1010 and is bent to face the front surface 1010*a* of the frame panel 1010. Accordingly, the extending portion 1010*c*-1 may interfere with a rear end portion 1210*d* of the support member 1200 and fix the support member 1200.

That is, the first support surface 1210*a* corresponding to the front surface of the support member 1200 may be in contact with the front surface 1010*a* of the frame panel 1010 and the rear end portion 1210*d* corresponding to a rear end of the support member 1200 is in contact with the extending portion 1010*c*-1 of the frame panel 1010 and fixed to the frame panel 1010.

In addition, the extending portion 1010*c*-1 may include a plurality of extending protrusions 1010*c*-2 arranged at a predetermined interval. The plurality of extending protrusions 1010*c*-2 are integrally formed with the extending portion 1010*c*-1 and may be bent together with the extending portions 1010*c*-1.

The plurality of extending protrusions 1010*c*-2 may be in contact with the sliding coupling portion 1240 of the support member 1200 to additionally support the support member 1200.

The plurality of extending protrusions 1010*c*-2 are arranged at positions corresponding to a slide slot portions 1140 of the corner member 1100 and are not interfered with the corner member 1100.

However, the plurality of extending protrusions 1010*c*-2 may not be in direct contact with the support member 1200 as necessary, and here, the plurality of extending protrusions 1010*c*-2 may be used as an indicator visually indicating that the extending portions 1010*c*-1 are formed to be bent.

The slide coupling portion 1240 of the support member 1200 may be disposed on one side of the support member 1200 and may be slidably coupled to the slide slot portion 1140 of the corner member 1100. Accordingly, the slide coupling portion 1240 may couple the support member 1200 and the corner member 1100.

In addition, a plurality of slide coupling portions 1240 may be provided, and the plurality of slide coupling portions 1240 may be arranged at a predetermined interval on one side of the support member 1200.

For example, the slide coupling portion 1240 may include a first slide coupling portion 1240*a* and a second slide coupling portion 1240*b* disposed at a predetermined interval in a longitudinal direction L of the corner member 1100.

The first slide coupling portion 1240*a* and the second slide coupling portion 1240*b* may be disposed at both end portions of the corner member 1100 in the longitudinal direction L. Accordingly, the corner member 1100 coupled to the support member 1200 may be prevented from being rotated in one direction with respect to the support member 1200 through the first slide coupling portion 1240*a* and the second slide coupling portion 1240*b*.

However, the slide coupling portion 1240 may be disposed at various positions of the support member 1200 according to design requirements.

In addition, the slide coupling portion 1240 may have a 'T' shape in cross-section. Accordingly, even when the corner member 1100 is coupled to the slide coupling portion 1240, the corner member 1100 may be prevented from being separated from the support member 1200.

However, the shape of the slide coupling portion 1240 may vary as necessary.

The corner member 1100 may include a slide slot portion 1140 slidably coupled with the slide coupling portion 1240.

The number of the slide slot portions 1140 may be equal to the number of the slide coupling portions 1240 and a shape of the slide slot portion 1140 may be the same as a shape of the slide coupling portion 1240. In addition, the slide slot portion 1140 may be formed at a position corresponding to a position where the slide coupling portion 1240 is formed.

For example, in case that the slide coupling portion 1240 includes a first slide coupling portion 1240*a* and a second slide slot portion 1240*b*, the slide slot portion 1140 may include a first slide slot portion 1140*a* inserted into the first slide coupling portion 1240*a* and a second slide slot portion 1140*b* inserted into the second slide coupling portion 1240*b*.

Accordingly, as described above, the structure according to another embodiment of the disclosure may simultaneously fill the plurality of gaps S1 and S2 of the frame panel 1010 through the corner member 1100 and stably support the structure of the frame panel 1010 through the support member 1200.

In addition, through a simple coupling method of the fixing member 1100 and the support member 1200, a firm structure may be realized and a manufacturing cost may be reduced.

Hereinafter, a method of manufacturing a panel assembly according to another embodiment of the disclosure will be described in detail with reference to FIGS. 8 to 10.

Figure 8:
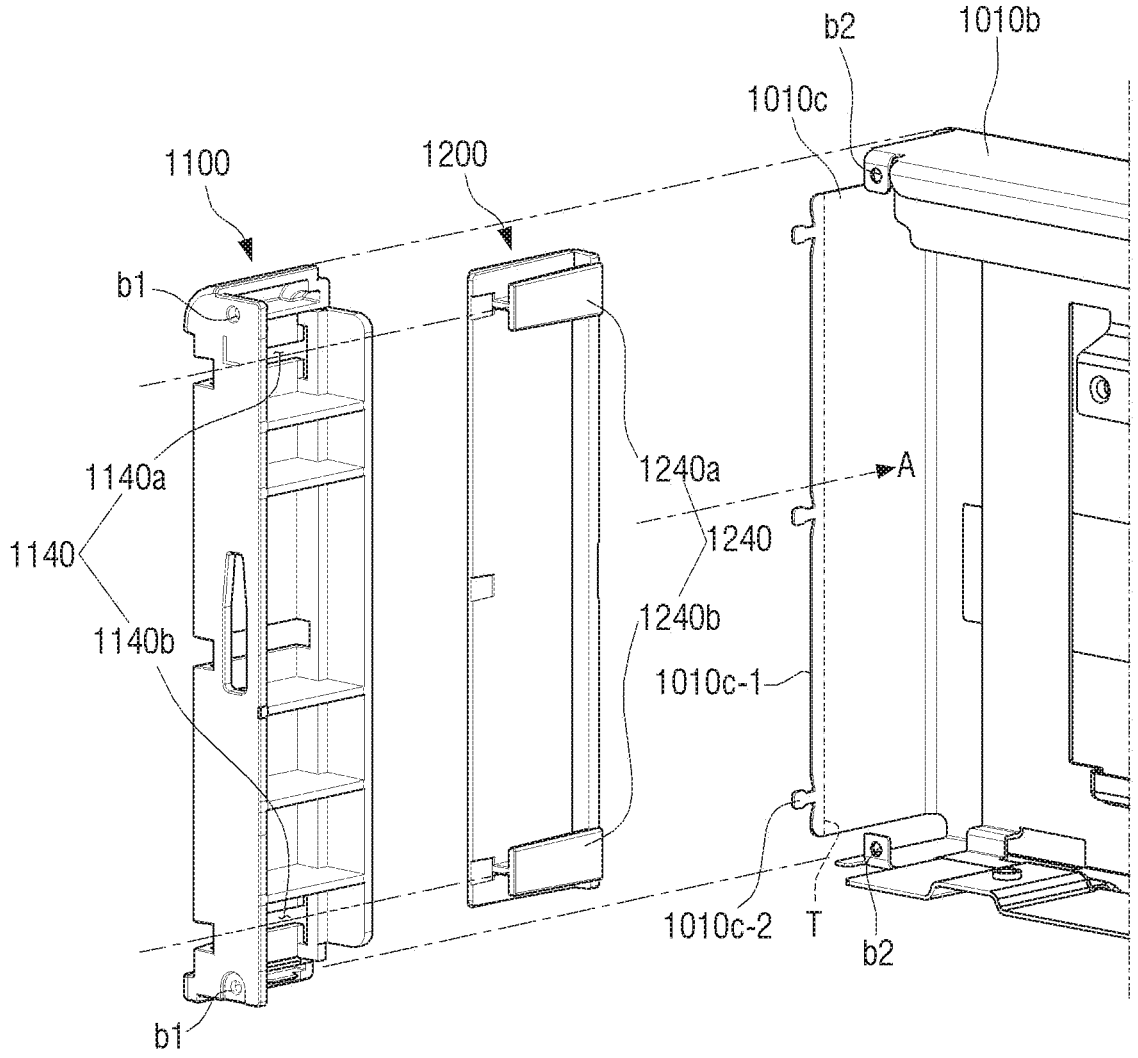
FIG. 8 is a rear perspective view illustrating a process of assembling a panel assembly.
Figure 9:
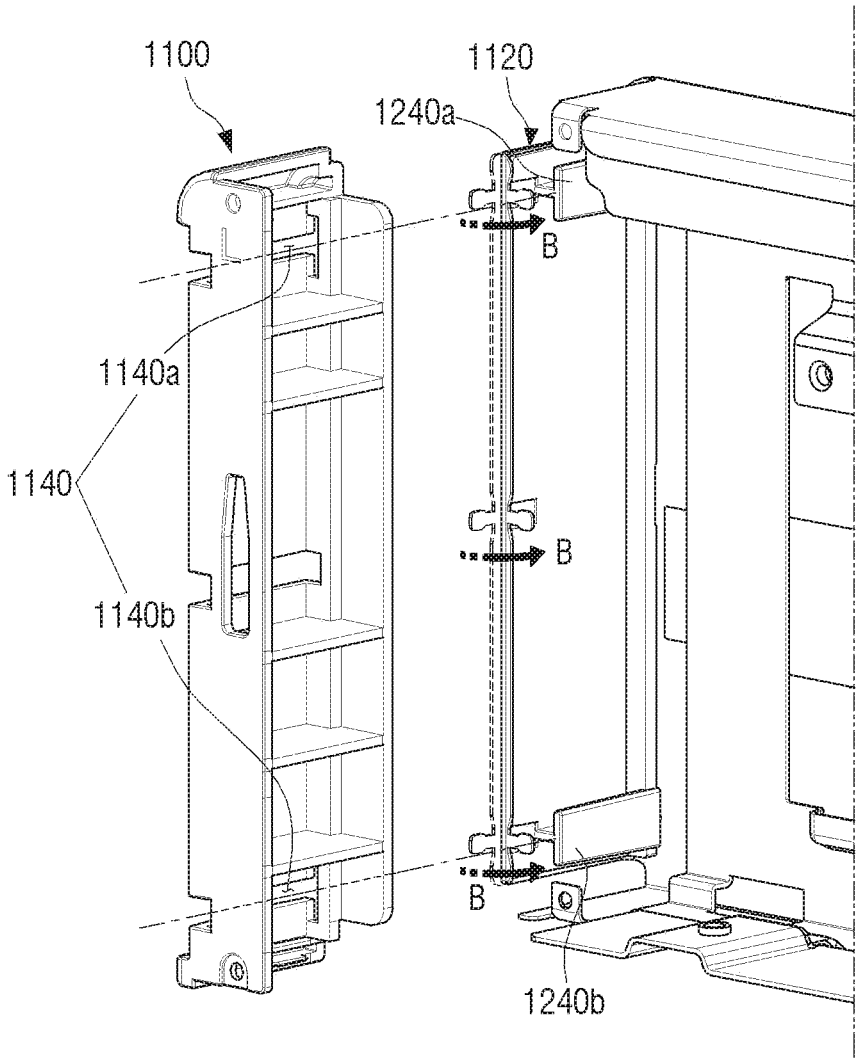
FIG. 9 is a rear perspective view illustrating a process of assembling a panel assembly.
Figure 10:
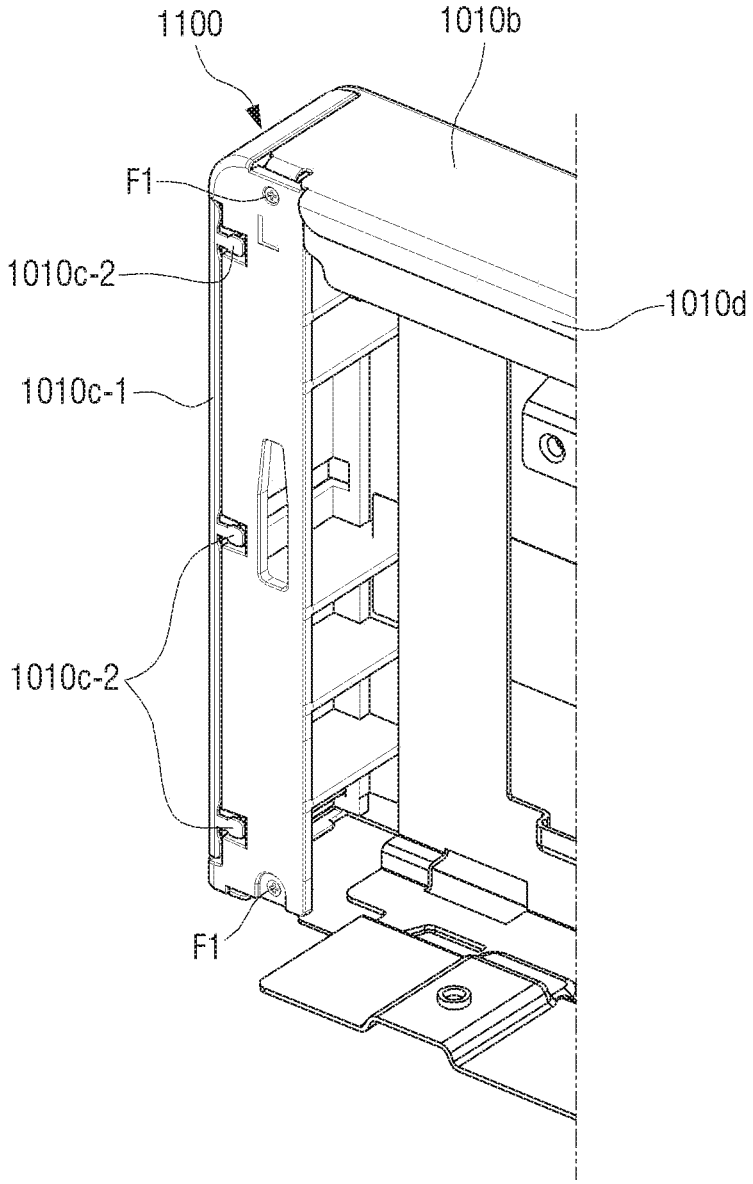
FIG. 10 is a rear perspective view illustrating a process of assembling a panel assembly.

FIGS. 8 to 10 are rear perspective views illustrating a process of assembling a panel assembly.

First, as illustrated in FIG. 8, the support member 1200 disposed at the rear of the frame panel 1010 moves in a direction A and is disposed to be in contact with the front surface 1010*a* and the side surface 1010*c* of the frame panel 1010.

Thereafter, as illustrated in FIG. 9, in a state in which the support member 1200 is in contact with the front surface 1010*a* and the side surface 1010*c* of the frame panel 1010, the extending portion 1010*c* of the frame panel 1010 may be bent in a direction B along a folding line T to face the front surface 1010*a* of the frame panel 1010.

The extending portion 1010*c*-1 of the frame panel 1010 may be in contact with the rear end portion 1210*d* of the support member 1200 to support the rear end portion 1210*d* of the support member 1200. Accordingly, the support member 1200 may be fixed to the frame panel 1010.

Thereafter, as illustrated in FIG. 10, the slide slot portion 1140 of the corner member 1100 may slidably move to the slide coupling portion 1240 of the support member 1200, and accordingly, the corner member 1100 may be coupled to the support member 1200.

Thereafter, in a state in which the corner member 1100 is coupled to the support member 1200, fastening screws F1 are coupled to first screw holes b1 located at the both ends of the corner member 1100 and second screw holes b1 formed at the frame panel 1010, thereby fixing the corner member 1100 to the frame panel 1010.

As described above, unlike a case where the corner member 1100 itself is directly coupled to the frame panel 1010, the additional fixing member (not shown) is disposed on the rear of the corner member 1100 and the additional fixing member is fixed to the frame panel 1010, whereby the corner member 110 may be indirectly fixed to the frame panel 1010.

Various exemplary embodiments of the disclosure have been individually described but the exemplary embodiments may not necessarily be implemented alone and components and operations of the respective exemplary embodiments may be combined with at least any other exemplary embodiment to be implemented.

Although the exemplary embodiments have been illustrated and described hereinabove, the disclosure is not limited to the above-mentioned specific exemplary embodiments, but may be variously modified by those skilled in the art without departing from the scope and spirit of the disclosure as disclosed in the accompanying claims. These modifications should also be understood to fall within the scope of the disclosure.

What is claimed is:

1. A panel assembly comprising:

a frame panel including a front surface, an upper surface, a side surface, and a rear surface formed from a single sheet of a metal plate; and a corner member disposable in a gap formed between the upper surface of the frame panel and the side surface of the frame panel, wherein the corner member includes:

an insertion member insertable into the gap to fill the gap, and a fixing member integrally formed with the insertion member and couplable to the rear surface of the frame panel, to fix the corner member to the frame panel, when the insertion member is inserted into the gap, wherein the upper surface of the frame panel and the side surface of the frame panel are each bent from edges of the front surface of the frame panel and the rear surface of the frame panel is formed by end portions bent from the upper surface of the frame panel and the side surface of the frame panel to face the front surface of the frame panel, wherein the fixing member includes a fixing surface in contact with the rear surface of the frame panel, wherein the fixing surface of the fixing member includes a first coupling protrusion insertable into a first coupling opening formed on the rear surface of the frame panel when the insertion member is inserted into the gap, and wherein another surface of the fixing member includes a third coupling opening formed at a position corresponding to a second coupling opening formed on at least one of the upper surface of the frame panel and the side surface of the frame panel when the insertion member is inserted into the gap.

2. The panel assembly as claimed in claim 1, wherein the insertion member includes a contact protrusion to be in contact with at least one of the upper surface of the frame panel and the side surface of the frame panel when the insertion member is inserted into the gap.

3. The panel assembly as claimed in claim 2, wherein the contact protrusion is formed in a longitudinal direction of the insertion member.

4. The panel assembly as claimed in claim 1, wherein an outer surface of the insertion member is formed to extend from the upper surface of the frame panel to the side surface of the frame panel to form a smooth transition from the upper surface of the frame panel to the side surface of the frame panel when the insertion member is inserted into the gap.

5. The panel assembly as claimed in claim 4, wherein the outer surface of the insertion member is formed to have a predetermined curvature to match the gap formed between the upper surface of the frame panel and the side surface of the frame panel.

6. The panel assembly as claimed in claim 5, wherein a radius of the curvature is 2 mm or less.

7. The panel assembly as claimed in claim 1, wherein the corner member is formed of a synthetic resin material.

8. The panel assembly as claimed in claim 1, wherein the side surface of the frame panel includes left and right sides of the frame panel.

9. The panel assembly comprising:

a frame panel including a front surface, an upper surface, a side surface, and a rear surface formed from a single sheet of a metal plate; and a corner member disposable in gap formed between the upper surface of the frame panel and the side surface of the frame panel, wherein the corner member includes:

an insertion member insertable into the gap to fill the gap, and a fixing member integrally formed with the insertion member and couplable to the rear surface of the frame panel, to fix the corner member to the frame panel, when the insertion member is inserted into the gap, wherein the upper surface of the frame panel and the side surface of the frame panel are each bent from edges of the front surface of the frame panel and the rear surface of the frame panel is formed by end portions bent from the upper surface of the frame panel and the side surface of the frame panel to face the front surface of the frame panel, wherein the fixing member includes a fixing surface in contact with the rear surface of the frame panel, wherein the fixing surface of the fixing member includes a first coupling protrusion insertable into a first coupling opening formed on the rear surface of the frame panel when the insertion member is inserted into the gap, wherein the frame panel further includes a lower surface bent from an edge of the front surface of the frame panel, and wherein the corner member further includes:

an additional insertion member disposable in an additional gap formed between the side surface of the frame panel and the lower surface of the frame panel to fill the additional gap, and a connecting member connecting the insertion member and the additional insertion member.

10. The panel assembly as claimed in claim 9, wherein the insertion member, the additional insertion member, and the connecting member are integrally formed.

11. The panel assembly as claimed in claim 10, further comprising:

a support member disposed to be in contact with the front surface of the frame panel and the side surface of the frame panel and having a slide coupling portion to receive the corner member.

12. The panel assembly as claimed in claim 11, wherein the corner member includes a slide slot portion to be slidably coupled to the slide coupling portion.

13. The panel assembly as claimed in claim 12, wherein one end of the side surface of the frame panel has an extending portion extending along the one end of the side surface of the frame panel to fix the support member.

* * * * *